US005433328A

United States Patent [19]

Baron et al.

[11] Patent Number: 5,433,328

[45] Date of Patent: Jul. 18, 1995

[54] BABY BOTTLE EXTENSION ASSEMBLY HAVING STORAGE CHAMBER AND RELEASE MECHANISM

[76] Inventors: Moises S. Baron; Sharon Lerner-Baron, both of 637 Third Ave., Ste. F, Chula Vista, Calif. 91910

[21] Appl. No.: 245,217

[22] Filed: May 17, 1994

[51] Int. Cl.[6] ..... A61J 9/00

[52] U.S. Cl. ..... 215/11.4; 215/DIG. 8; 222/525

[58] Field of Search ..... 215/11.1, 11.4, DIG. 8; 222/425, 524, 525, 207, 442, 450

[56] References Cited

U.S. PATENT DOCUMENTS

| | | | |
|---|---|---|---|
| Re. 29,916 | 2/1979 | Schmid et al. | 426/117 |
| 730,337 | 6/1903 | Bonnefont | 215/11.1 |
| 2,786,769 | 3/1957 | Greenspan | 99/171 |
| 2,793,776 | 5/1957 | Lipari | 215/6 |
| 2,807,384 | 9/1957 | Lipari | 215/11.1 |
| 2,813,649 | 11/1957 | Lipari | 215/11.1 |
| 2,843,281 | 7/1958 | Gallois | 215/11.1 |
| 2,885,104 | 5/1959 | Greenspan | 215/6 |
| 2,931,731 | 4/1960 | Pohjola | 99/171 |
| 3,093,256 | 6/1963 | Woodbury, Jr. | 215/11.1 |
| 3,323,669 | 6/1967 | Yazaki | 215/11.1 |
| 4,135,513 | 1/1979 | Arisland | 215/11.4 |
| 4,253,588 | 3/1981 | Lester et al. | 222/525 X |
| 4,856,995 | 8/1989 | Wagner | 433/215 |
| 4,979,629 | 12/1990 | Askerneese | 215/11.1 |
| 5,060,811 | 10/1991 | Fox | 215/6 |
| 5,275,298 | 1/1994 | Holley, Jr. et al. | 215/11.4 |
| 5,295,597 | 3/1994 | Green | 215/11.1 X |

FOREIGN PATENT DOCUMENTS

| | | | |
|---|---|---|---|
| 410922 | 1/1991 | European Pat. Off. | 222/524 |
| 679145 | 12/1991 | Switzerland | 215/11.1 |

*Primary Examiner*—Allan N. Shoap
*Assistant Examiner*—Christopher J. McDonald
*Attorney, Agent, or Firm*—John R. Flanagan

[57] ABSTRACT

An extension assembly is adapted to fit between a tubular container of a baby bottle and a nipple end cap of the baby bottle. The extension assembly an elongated storage container body threadably coupled at an upper end with a lower end of the nipple end cap of the baby bottle and having an internal storage chamber for holding a quantity of food material, a release mechanism threadably coupled to an upper end of the tubular container of the baby bottle for controlling access to the quantity of food material in the storage container body by the quantity of water stored in the tubular container of the baby bottle, and an outer ring mounting the storage container body to undergo movement toward and away from the upper end of the tubular container of the baby bottle so as to convert lower and upper members of the release mechanism between a closed condition blocking access by the water in the tubular container of the baby bottle with the food material in the storage container of the extension assembly and an opened condition permitting access by the water in the tubular container of the baby bottle to the food material stored in the container body of the extension assembly to facilitate shaking and mixing of the water with the food material.

26 Claims, 2 Drawing Sheets

BABY BOTTLE EXTENSION ASSEMBLY HAVING STORAGE CHAMBER AND RELEASE MECHANISM

BACKGROUND OF THE INVENTION

1. Field of the Invention

The present invention generally relates to baby nursing or feeding bottles and, more particularly, is concerned with a baby bottle extension assembly having a storage chamber and release mechanism.

2. Description of the Prior Art

Bottle fed babies are typically fed a milk-like mixture of water and a liquid baby food material generally referred to as "baby formula" which can be purchased in any grocery store or supermarket. For various reasons, one of which is food freshness and nutritional wholesomeness, it is desirable to be able to mix the baby formula with the required quantity of water just before feeding the mixture to the baby.

Thus, when a baby is taken on a trip away from home, an adult caring for the baby must transport one or more bottles filled with water and also transport one or more containers of baby formula separately therefrom for mixing therewith when it is time to feed the baby. Thus, it would be desirable to provide a device having a design which facilitate the process of preparing, transporting and utilizing baby bottles at all times of the day and night and in all places. Such design would allow for the water and baby formula to remain separate within the bottle, until the moment that they need to be mixed to feed to the baby, and would employ currently used standard baby bottle constructions.

Designs have been proposed in the prior patent art to provide baby bottles with separate compartments for containing food ingredients to be mixed and fed together or even to be fed separately from the bottle. Representative examples of such designs are the ones discloses in Swiss patent to Fluck (679,145) and in U.S. patents to Greenspan (U.S. Pat. Nos. 2,786,769; 2,885,104), Lipari (U.S. Pat. No. 2,793,776; 2,807,384; 2,813,647), Gallois (U.S. Pat. No. 2,843,281), Pohjola (U.S. Pat. No. 2,931,731), Wagner (U.S. Pat. No. 4,856,995), Askerneese (U.S. Pat. No. 4,979,629) and Fox (U.S. Pat. No. 5,060,811).

The above-cited U.S. patents to Lipari disclose various embodiments of a compartmental nursing bottle. U.S. Pat. No. 2,793,776 discloses a nursing bottle having an outer container filled with water and an inner tubular body filled with a formula being supported within the outer container and having a plunger slidable therein for opening communication between the inner tubular body and the interior chamber of the outer container. U.S. Pat. No. 2,807,384 discloses a nursing bottle having upper and lower compartments filled with formula and water respectively and separated by a rupturable diaphragm disposed across a restricted passage connecting the compartments. A valve and stopper assembly is provided in the upper compartment and operable for effecting rupture of the diaphragm. U.S. Pat. No. 2,813,649 discloses a nursing bottle similar to that of the previous patent, except that the latter uses a movable stopper to close and open the restricted passage.

The Lipari compartmental nursing bottle designs appear to be overly complicated and furthermore are not adapted for use with the generally accepted standard baby bottle constructions. As a result, the Lipari designs do not appear to be a satisfactory approach to the objective of providing a baby bottle design having features which would faciliate the separate storage of water and baby formula and then the easy mixing thereof at the moment that they need to be mixed in order to feed the baby, which design utilizes to the extent feasible currently accepted baby bottle constructions.

Consequently, a need still exists for a design which meets the desired performance objectives and is compatiable with current baby bottle constructions.

SUMMARY OF THE INVENTION

The present invention provides a baby bottle extension designed to satisfy the aforementioned need. The extension assembly of the present invention is adapted to fit between a tubular container and a nipple supporting end cap of a standard baby bottle. Thus, the extension assembly is designed to complement currently used standard baby bottles.

Accordingly, the present invention is directed to a baby bottle extension assembly adapted to fit with and between a tubular container of a baby bottle and a nipple end cap of the baby bottle. The extension assembly comprises: (a) means for storing a quantity of food material, the storing means being connectable at an upper end with a lower end of the nipple end cap of the baby bottle; (b) means for controlling access by water in the tubular container of the baby bottle with food material stored in the storing means, the controlling means being connectable with an upper end of the tubular container of the baby bottle; and (c) means for mounting the storing means to undergo movement toward and away from the upper end of the tubular container of the baby bottle so as to convert the access controlling means between a closed condition blocking access by water in the tubular container of the baby bottle with the food material in the storage container of the extension assembly and an opened condition permitting access by the water in the tubular container of the baby bottle to the food material stored in the container body of the extension assembly to facilitate shaking and mixing of the water with the food material.

The access controlling means includes a lower member and an upper member. The lower member includes an inner annular ring and an inner and outer attaching structures in the form of sets of threads defined thereon. The inner set of threads releasably screw onto complementary threads about the exterior of the upper end of the tubular container of the baby bottle. The upper member is rigidly connected to the lower end of the storing means and is movable toward and away from the lower member between the closed and opened conditions upon movement of the storing means toward and away from the upper end of the tubular container of the baby bottle.

Two embodiments of the release controlling means are disclosed. In one embodiment, the lower member has a central plug structure supported within the annular ring and the upper member includes an annular funnel structure having a central passageway. The plug structure is sealably received in the central passageway of the annular funnel structure when the upper and lower members are in the closed condition and is withdrawn therefrom when the upper and lower members are in the opened condition. In the other embodiment, the upper member includes a central plate structure with radial spokes supported by a lower end of the storing means and the lower member includes an annular rim structure attached on the annular ring and projecting inwardly therefrom. The central plate structure is seated on the annular rim structure when the upper and lower members are in the closed condition and is unseated therefrom when the upper and lower members are in the opened condition.

The mounting means includes an outer annular ring having spaced upper and lower ends. The outer annular ring is greater in axial length than the inner annular ring and has an inner attaching structure in the form of a set of threads defined on an interior surface of the lower end thereof which screw onto the set of threads on the exterior of the inner annular ring of the release controlling means. The outer annular ring also has a stop structure in the form of an annular flange attached to and projecting radially inwardly from the upper end of the outer annular ring which functions to limit movement of the storing means away from the upper end of the tubular container and the lower member of the release controlling means.

The storing means includes an elongated annular container body having an internal storage chamber and spaced upper and lower open ends. An outer attaching structure in the form of a set of threads is defined on an exterior surface of the upper end thereof which screw into a set of threads on the interior surface of the lower end of the nipple end cap.

The annular container body includes a lower annular body portion and an upper annular body portion. The lower annular body portion is fitted within the annular outer ring and movable between the upper annular flange on the upper end thereof and the lower annular flange defined on the annular inner ring being spaced axially below the upper annular flange. The respective upper and lower annular flanges define upper and lower stops which limit the axial displacement of the annular container body of the storing means within the outer annular ring of the mounting means toward and away from the upper end of tubular container of the baby bottle.

In one embodiment of the container body, the lower annular body portion is fitted within the annular outer ring for axial sliding movement between the upper and lower annular flanges. In another embodiment of the container body, the lower annular body portion is fitted within the annular outer ring and has a set of exterior threads screwed into a set of interior threads on the interior surface of the outer annular ring. The container body is thereby can undergo rotatable threaded movement between the upper and lower annular flanges.

The upper annular body portion is rigidly connected to the lower annular body portion and extends upwardly therefrom. The upper annular body portion has an outside diameter sufficiently less than the outside diameter of the lower annular body portion such that the upper annular body portion may extend from the upper end of the outer annular ring past the inwardly projecting upper annular flange thereon.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 4:
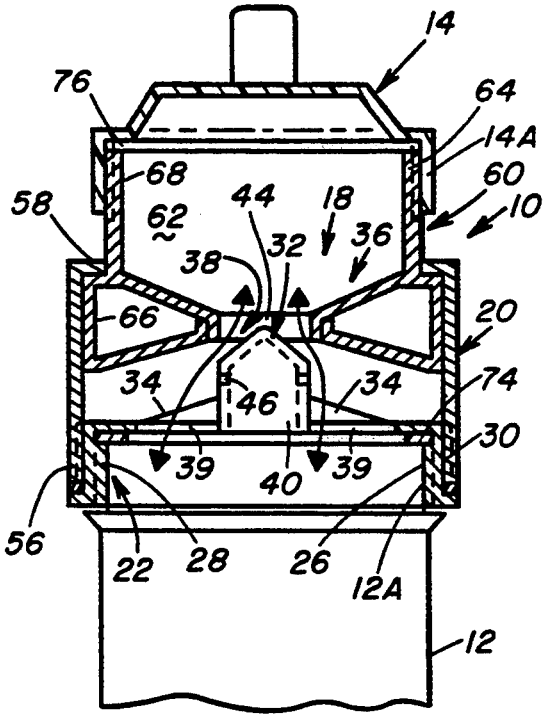
FIG. 4 is a vertical sectional view of the baby bottle extension assembly with the components thereof in an opened condition.
Figure 1:
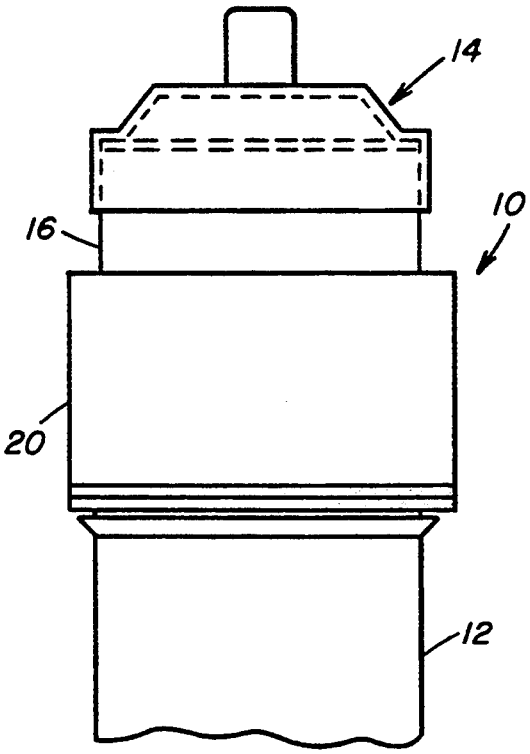
FIG. 1 is a side elevational view of a first embodiment of a baby bottle extension assembly of the present invention being shown coupled between an upper end of a tubular container of a standard baby bottle and a lower end of the nipple supporting end cap of the standard baby bottle.
Figure 2:
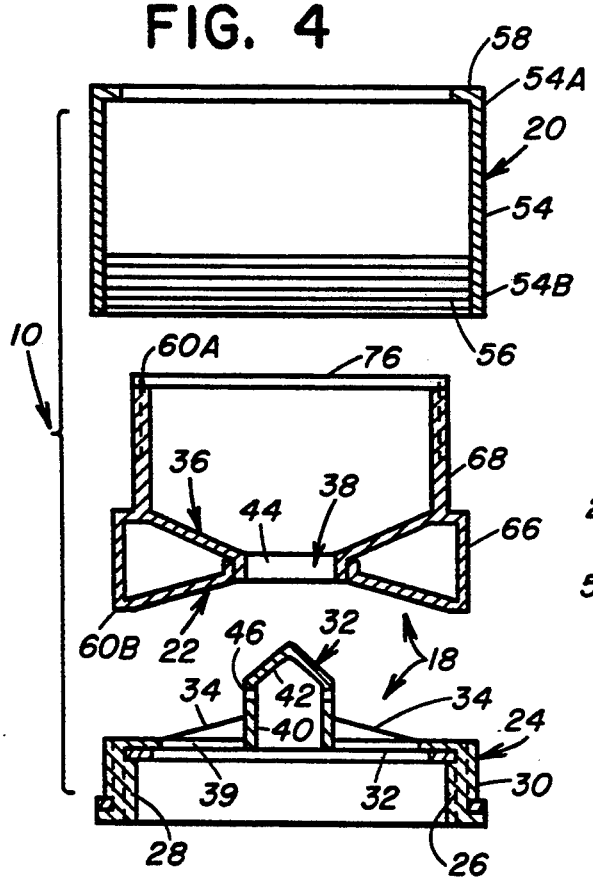
FIG. 2 is an exploded vertical sectional view of the baby bottle extension assembly of FIG. 1.
Figure 3:
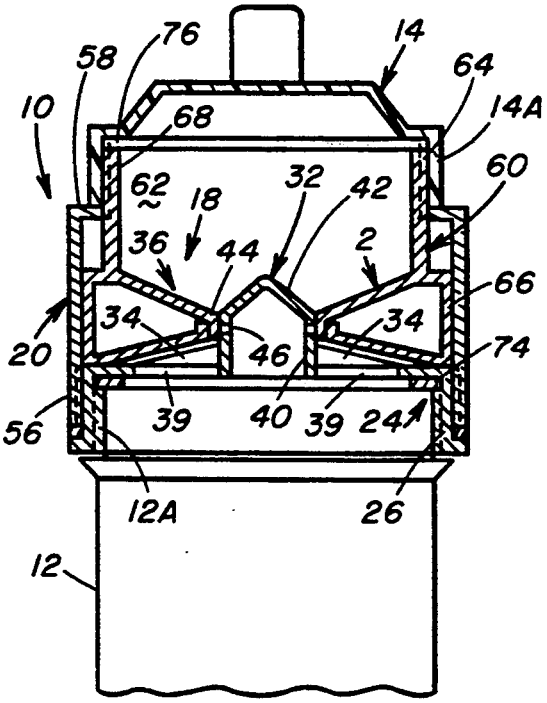
FIG. 3 is a vertical sectional view of the baby bottle extension assembly with the components thereof in a closed condition.

Referring to the drawings, and particularly to FIGS. 1–3, there is illustrated a baby bottle extension assembly of the present invention, generally designated 10. The extension assembly 10 is adapted to fit between a tubular container 12, and a nipple supporting end cap 14 of a standard baby bottle. The extension assembly 10 basically includes means 16 for storing a quantity of food material, means 18 for controlling access to the quantity of food material stored in the storing means 16 by water stored in the tubular container 12 of the baby bottle, and means 20 for mounting the storing means 16 to undergo movement toward and away from the tubular container 12. The storing means 16 is connected with an internally-threaded lower end 14A of the nipple end cap 14 of the baby bottle. The access controlling means 18 includes an upper member 22 connected to the storing means 16 and a lower member 24 connected with an externally-threaded upper end 12A of the tubular container 12 of the baby bottle. By facilitating movement of the storing means 16 between lower and upper positions, as seen respectively in FIGS. 3 and 4, the mounting means 20 permits conversion of the upper and lower members 22, 24 of the release controlling means 18 between a closed condition, as seen in FIG. 3, wherein the access by water to food material is blocked and thus mixing and shaking of the water with the food material is prevented between the storing means 16 and the tubular container 12 of the baby bottle and an opened condition, as seen in FIG. 4, wherein access of water with the food material is released and mixing and shaking of the water with the food material is permitted between the storing means 16 and the tubular container 12 of the baby bottle.

Referring to FIGS. 2–6, as mentioned above, the release controlling means 18 of the extension assembly 10 includes the lower member 22 and the upper member 24. The lower member 22 includes an inner annular ring 26 having inner and outer attaching structures 28, 30 in the form of sets of threads defined thereon. The inner set of threads 28 releasably screw onto complementary threads about the exterior of the upper end 12A of the tubular container 12 of the baby bottle. The upper member 24 is rigidly attached to the lower end of the storing means 16 and is movable toward and away from the lower member 24 between the closed and opened conditions upon movement of the storing means 16 toward and away from the upper end 12A of the tubular container 12 of the baby bottle.

Two embodiments of the access controlling means 18 are disclosed herein, being illustrated respectively in FIGS. 2–4 and FIGS. 5–7. In the one embodiment of FIGS. 2–4, the lower member 24 also includes a central plug structure 32 supported by a plurality of radial spokes 34 within the inner annular ring 26, while the upper member 22 includes an annular funnel structure 36 with a central passageway 38 defined therethrough. The top and bottom sides of the funnel structure 36 have frusto-conical concave shapes. The central plug structure 32 has a cylindrical body 40 with an upper conical end 42 for guiding the plug structure 32 into the central passageway 38. The cylindrical body 40 is sealed with the inner annular rim 44 defining the central passageway 38 by an annular O-ring 46 fitted about the cylindrical body 40 when the upper and lower members 22, 24 are in the closed condition, as seen in FIG. 3. The central plug structure 32 is withdrawn and unsealed therefrom when the upper and lower members 22, 24 are in the opened condition. The spaces 39 defined between the radial spokes 34 the mixing and shaking of water and food material through the central passageway 38 and the spaces 39 and between the storing means 16 of the extension assembly 10 and the tubular container 12 of the baby bottle.

Figure 6:
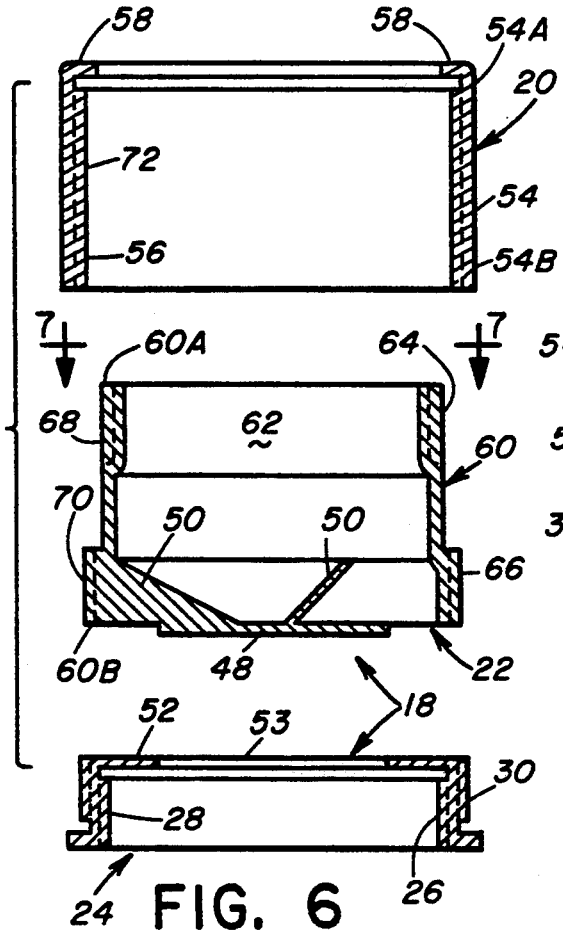
FIG. 6 is an exploded vertical sectional view of the baby bottle extension assembly of FIG. 5.
Figure 7:
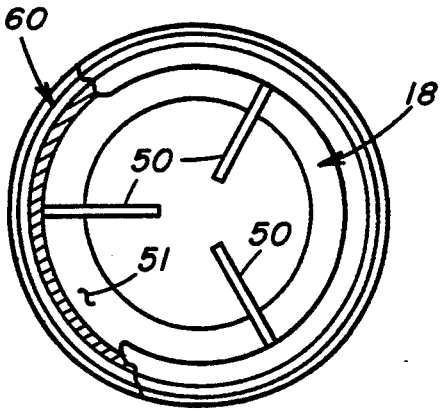
FIG. 7 is a top plan view of a formula container body of the baby bottle extension assembly as seen along line 7—7 of FIG. 6.
Figure 5:
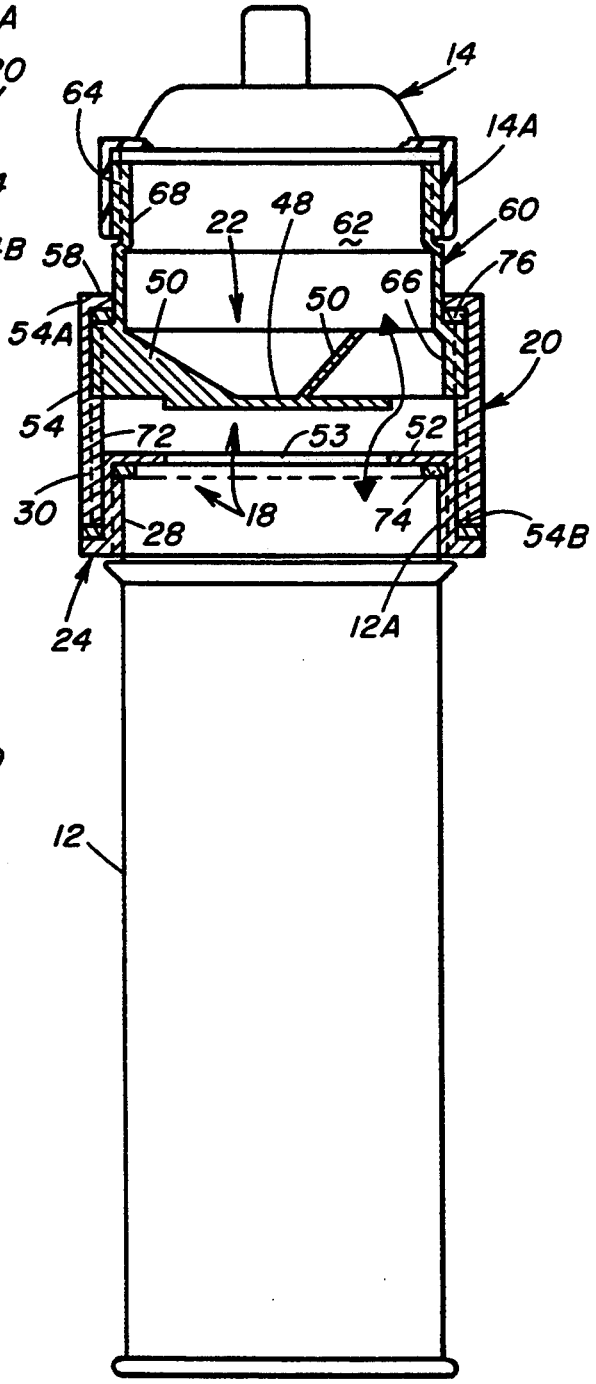
FIG. 5 is a side elevational view of a second embodiment of a baby bottle extension assembly of the present invention being shown coupled between the upper end of the tubular container and the lower end of the nipple supporting end cap of the standard baby bottle.

In the other embodiment of FIGS. 5–7, the upper member 22 includes a central plate structure 48 supported by a plurality of radial spokes 50 within the lower end of the storing means 16, while the lower member 24 has an annular flange 52 attached on the inner annular ring 26 and projecting inwardly therefrom. The central plate structure 48 is seated on the annular flange 52 when the upper and lower members 22, 24 are in the closed condition and is unseated therefrom when the upper and lower members 22, 24 are in the opened condition. In this embodiment also, there are spaces 51 defined between the radial spokes 50 which permit the shaking and mixing of water with food material through the spaces 51 pass the radial spokes 50 and through an opening 53 defined by the annular flange 52 and between the storing means 16 of the extension assembly 10 and the tubular container 12 of the baby bottle.

Referring to FIGS. 1–6, the mounting means 20 of the extension assembly 10 includes an outer annular ring 54 having spaced upper and lower ends 54A, 54B and an inner attaching structure 56 in the form of a set of threads defined on an interior surface of the lower end 54A thereof which screw onto the outer set of threads 30 on the exterior of the inner annular ring 26 of the access controlling means 18. The outer annular ring 54 also has a stop structure in the form of an upper annular flange 58 attached to and projecting radially inwardly from the upper end 54A of the outer annular ring 54 which functions to limit movement of the storing means 16 away from the upper end 12A of the tubular container 12 and the lower member 24 of the access controlling means 18.

Referring to FIGS. 1–7, the storing means 16 of extension assembly 10 is an elongated annular container body 60 having an internal storage chamber 62 and spaced upper and lower open ends 60A, 60B. An outer attaching structure 64 in the form of a set of threads is defined on an exterior surface of the upper end 60A thereof which screw into the internally-threaded lower end 14A of the nipple end cap 14. The annular container body 60 includes a lower annular body portion 66 and an upper annular body portion 68. The lower annular body portion 66 is fitted within the annular outer ring 54 and movable between the upper annular flange 58 on the upper end 54A thereof and the lower annular flange 52 defined on the annular inner ring 26 being aligned with and spaced axially below the upper annular flange 58. The respective upper and lower annular flanges 58, 52 define upper and lower stops limit the axial displacement of the lower annular body portion 66 and thereby the container body 60 of the storing means 16 within the outer annular ring 54 of the mounting means 20 toward and away from the upper end 12A of tubular container 12 of the baby bottle.

The upper and lower annular flanges 58, 52 are also displaced through a distance greater than the height of the lower annular body portion 66 of the container body 60 so as to permit axial movement of the container body 60 relative thereto. There are two embodiments of the manner of movably mounting the container body 60 within the outer annular ring 54 disclosed herein, being illustrated respectively in FIGS. 2–4 and FIGS. 5–7. In the one embodiment of FIGS. 2–4, the lower annular body portion 66 is fitted within the annular outer ring 54 and can be pushed and pulled for axial sliding movement between the upper and lower annular flanges 58, 52. In the other embodiment of FIGS. 5–7, the lower annular body portion 66 is fitted within the annular outer ring 54 and has a set of exterior threads 70 screwed into a complementary set of threads 72 on the interior surface of the outer annular ring 54. The container body 60 is thereby can undergo rotatable threaded movement between the upper and lower annular flanges 58, 52.

The upper annular body portion 68 of container body 60 is rigidly connected to the lower annular body portion 66 and extends upwardly therefrom. The upper annular body portion 68 has an outside diameter sufficiently less than the outside diameter of the lower annular body portion 66 such that the upper annular body portion 68 may extend from the upper end 54A of the outer annular ring 54 past the inwardly projecting upper annular flange 58 thereon.

In summary, the baby bottle extension assembly 10 is adapted to fit between the tubular container 12 and the nipple supporting end cap 14 of a standard baby bottle. Annular seals 74, 76 are preferably provided between the lower and upper ends of the extension assembly 10 and the tubular container 12 and end cap 14. The extension assembly 10 includes a plurality of components, as described above, which couple with the upper end 12A of the tubular container 12 and the lower end 14A of the nipple end cap 14. The components of the extension assembly 10 define the food material storage chamber 62 and the release or access control mechanism 18 therein and are adjustable, either by push-pull or rotating, between closed, or storage, and opened, or release, conditions.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An extension assembly adapted to fit between a tubular container and a nipple end cap of a baby bottle, said extension assembly comprising:

(a) means for storing a quantity of food material, said storing means being connectable at an upper end with a lower end of the nipple end cap of the baby bottle;

(b) means for controlling access by water in the tubular container of the baby bottle to the quantity of food material in said storing means, said access controlling means being connectable with an upper end of the tubular container of the baby bottle; and (c) means for mounting said storing means to undergo movement toward and away from the upper end of the tubular container of the baby bottle so as to convert said access controlling means between a closed condition blocking access by the water in the tubular container of the baby bottle with the food material in said storing means and an opened condition permitting access by the water in the tubular container of the baby bottle to the food material stored in said storing means to facilitate shaking and mixing of the water with the food material;

(d) said access controlling means including (i) a lower member having an inner attaching structure defined thereon being fittable about and attachable to an exterior portion of the tubular container of the baby bottle adjacent the upper end thereof, and (ii) an upper member coupled to a lower end of said storing means, said upper member being movable toward and away from said lower member between closed and opened conditions therewith upon movement of said storing means toward and away from the upper end of the tubular container of the baby bottle to thereby respectively prevent and permit access by water in the tubular container of the baby bottle to the food material in said storing means;

(e) said mounting means including (i) an outer member having spaced upper and lower ends, (ii) an inner attaching structure defined on said lower end of said outer member for connecting with an outer attaching structure defined on said lower member of said access controlling means on an opposite side of said lower member from said inner attaching structure defined thereon, and (iii) a stop structure defined on said upper end of said outer member for limiting movement of said storing means away from said access controlling means.

2. The extension assembly of claim 1 wherein said said lower member of said access controlling means includes a central plug structure.

3. The extension assembly of claim 2 wherein said upper member of said access controlling means includes an annular funnel structure having a central passageway, said plug structure being sealably received in said central passageway of said annular funnel structure when said upper and lower members are in said closed condition and being withdrawn therefrom when said upper and lower members are in said opened condition.

4. The extension assembly of claim 1 wherein said upper member of said access controlling means includes a central plate structure.

5. The extension assembly of claim 4 wherein said lower member of said access controlling means is an annular rim structure, said central plate structure being seated on said rim structure when said upper and lower members are in said closed condition and being unseated therefrom when said upper and lower members are in said opened condition.

6. The extension assembly of claim 1 wherein said storing means includes:

an elongated annular container body having an internal storage chamber and spaced upper and lower open ends; and an attaching structure defined about said upper open end of said body for connecting with the lower end of the nipple end cap of the baby bottle.

7. The extension assembly of claim 6 wherein said access controlling means includes:

a lower member having an inner attaching structure defined thereon for connecting with the upper end of the tubular container of the baby bottle; and an upper member connected to said lower end of said container body of said storing means, said upper member being movable toward and away from said lower member between closed and opened conditions therewith upon movement of said storing means toward and away from the upper end of the tubular container of the baby bottle to thereby respectively prevent and permit access by water in the tubular container of the baby bottle to the food material in said storing means.

8. The extension assembly of claim 7 wherein said mounting means includes an outer member having spaced upper and lower ends, an inner attaching structure defined on said lower end for coupling with an outer attaching structure on said lower member of said controlling means, and a stop structure defined on said upper end for limiting movement of said container body of said storing means away from said controlling means.

9. The extension assembly of claim 8 wherein said lower member of said access controlling means includes an inner annular ring.

10. The extension assembly of claim 9 wherein said mounting means is an outer annular ring being greater in axial length than said inner annular ring.

11. The extension assembly of claim 10 wherein said inner attaching structure on said lower end of said mounting means is a set of threads formed on an interior surface of said outer annular ring.

12. The extension assembly of claim 10 wherein said stop structure defined on said upper end of said mounting means is an annular flange attached on an upper end of said outer annular ring and projecting radially inwardly therefrom.

13. The extension assembly of claim 12 wherein said annular container body includes:

a lower annular body portion fitted within said outer annular ring and movable between said annular flange on said upper end thereof and an annular flange defined on said inner annular ring being spaced axially below said annular flange on said upper end of said outer annular ring such that said respective annular flanges define upper and lower stops which limit the axial displacement of said storing means within said mounting means toward and away from the upper end of tubular container of the baby bottle; and an upper annular body portion connected to said lower annular body portion and extending upwardly therefrom, said upper annular body portion having an outside diameter sufficiently less than the outside diameter of said lower annular body portion such that said upper annular body portion extends from said upper end of said outer annular ring past said inwardly projecting annular flange thereof.

14. The extension assembly of claim 13 wherein upper annular body portion of said container body has outer attaching structure defined about said upper open end of said body in the form of a set of threads for connecting with the lower end of the nipple end cap of the baby bottle.

15. The extension assembly of claim 13 wherein said lower annular body portion is fitted within said outer annular ring for axial sliding movement between said annular flange on said upper end thereof and said annular flange on said inner annular ring.

16. The extension assembly of claim 13 wherein said lower annular body portion is fitted within said outer annular ring for rotatable screwing movement between said annular flange on said upper end thereof and said annular flange one said inner annular ring.

17. An extension assembly adapted to fit between a tubular container and a nipple end cap of a baby bottle, said extension assembly comprising:

(a) means for storing a quantity of food material, said storing means being connectable at an upper end with a lower end of the nipple end cap of the baby bottle;

(b) means for controlling access by water in the tubular container of the baby bottle to the quantity of food material in said storing means said access controlling means being connectable with an upper end of the tubular container of the baby bottle; and (c) means for mounting said storing means to undergo movement toward and away from the upper end of the tubular container of the baby bottle so as to convert said access controlling means between a closed condition blocking access by the water in the tubular container of the baby bottle with the food material in said storing means and an opened condition permitting access by the water in the tubular container of the baby bottle to the food material stored in said storing means to facilitate shaking and mixing of the water with the food material;

(d) said storing means including (i) an elongated annular container body having an internal storage chamber and spaced upper and lower open ends, and (ii) an attaching structure defined about said upper open end of said body for connecting with the lower end of the nipple end cap of the baby bottle;

(e) said access controlling means including (i) a lower member having an inner attaching structure defined thereon for connecting with the upper end of the tubular container of the baby bottle, and (ii) an upper member connected to said lower end of said container body of said storing means, said upper member being movable toward and away from said lower member between closed and opened conditions therewith upon movement of said storing means toward and away from the upper end of the tubular container of the baby bottle to thereby respectively prevent and permit access by water in the tubular container of the baby bottle to the food material in said storing means;

(f) said mounting means including (i) an outer member having spaced upper and lower ends, (ii) an inner attaching structure defined on said lower end of said outer member for coupling with an outer attaching structure on said lower member of said access controlling means, and (iii) a stop structure defined on said upper end of said outer member for limiting movement of said container body of said storing means away from said controlling means;.

(g) said lower member of said access controlling means including an inner annular ring;

(h) said inner and outer attaching structures on said lower member being respective sets of threads formed on exterior and interior surfaces of said inner annular ring.

18. A baby bottle, comprising:

(a) a tubular container having an exterior threaded upper end portion;

(b) a nipple end cap having a threaded lower end; and (c) an extension assembly adapted to fit between said tubular container and said nipple end cap, said extension assembly comprising (i) an elongated annular container body having an internal storage chamber for storing a quantity of food material and a pair of spaced upper and lower open ends, said body having a set of threads defined about said upper open end of said body for threadably connecting with said threaded lower end of said nipple end cap, said container body including a lower annular body portion and an upper annular body portion connected to said lower annular body portion and extending upwardly therefrom, said upper annular body portion having an outside diameter less than the outside diameter of said lower annular body portion, (ii) means for controlling access to the quantity of food material in said storage chamber of said container body by a quantity of water in said tubular container, said access controlling means including a lower member having an inner annular ring with inner and outer sets of threads defined thereon, said inner set of threads being releasably threaded onto said exterior threaded upper end portion of said tubular container, said access controlling means also including an upper member rigidly connected to said lower annular body portion of said container body at said lower open end thereof, and (iii) an outer annular ring having spaced upper and lower ends, an inner attaching structure defined on said lower end of said outer annular ring and threadably connected with an outer set of threads on said inner annular ring of said access controlling means, and a stop structure defined on said upper end of said outer annular ring, said lower annular body portion of said container body being mounted in said outer annular ring for undergoing limited movement between said inner annular ring and said stop structure on said upper end of said outer annular ring toward and away from said tubular container so as to convert said upper and lower members of said access controlling means between a closed condition blocking access by the water in the tubular container of the baby bottle with the food material in said storage container of said extension assembly and an opened condition permitting access by the water in the tubular container of the baby bottle to the food material stored in said container body of said extension assembly to facilitate shaking and mixing of the water with the food material.

19. The extension assembly of claim 18 wherein:

said lower member of said access controlling means includes an annular ring and a central stopper structure mounted within said inner annular ring; and said upper member of said access controlling means includes an annular funnel structure having a central passageway, said stopper structure being sealably received in said central passageway of said annular funnel structure when said upper and lower members are in said closed condition and being withdrawn therefrom when said upper and lower members are in said opened condition.

20. The extension assembly of claim 18 wherein:

said upper member of said access controlling means is a central plate structure supported by a lower end of said storage container of said storing means; and said lower member of said access controlling means includes an annular ring having an inwardly projecting annular rim structure, said central plate structure being seat on said rim structure when said upper and lower members are in said closed condition and being unseated therefrom when said upper and lower members are in said opened condition.

21. The extension assembly of claim 18 wherein said outer annular ring is greater in axial length than said inner annular ring.

22. The extension assembly of claim 18 wherein said stop structure defined on said upper end of said outer annular ring is an annular flange projecting radially inwardly therefrom.

23. The extension assembly of claim 22 wherein said lower annular body portion of said container body is fitted within said outer annular ring and movable between said annular flange on said upper end thereof and an annular flange defined on said inner annular ring being spaced axially below said annular flange on said upper end of said outer annular ring such that said respective annular flanges define upper and lower stops which limit the axial displacement of said container body toward and away from said upper end of said tubular container.

24. The extension assembly of claim 23 wherein said upper annular body portion has an outside diameter sufficiently less than an outside diameter of said lower annular body portion such that said upper annular body portion extends from said upper end of said outer annular ring past said inwardly projecting annular flange thereof.

25. The extension assembly of claim 24 wherein said lower annular body portion is fitted within said outer annular ring for axial sliding movement between said annular flange on said upper end thereof and said annular flange on said inner annular ring.

26. The extension assembly of claim 24 wherein said lower annular body portion is fitted thin said outer annular ring for rotatable screwing movement between said annular flange on said upper end thereof and said annular flange one said inner annular ring.

* * * * *